US006849000B2

(12) United States Patent
Chen

(10) Patent No.: US 6,849,000 B2
(45) Date of Patent: Feb. 1, 2005

(54) MULTI-FUNCTION GOLF TRAINING DEVICE

(76) Inventor: David Chen, No. 1598, Jungshan Rd., Shengang Shiang, Taichung (TW), 429

( * ) Notice: Subject to any disclaimer, the term of this patent is extended or adjusted under 35 U.S.C. 154(b) by 0 days.

(21) Appl. No.: 10/420,821

(22) Filed: Apr. 23, 2003

(65) Prior Publication Data

US 2004/0152529 A1 Aug. 5, 2004

(30) Foreign Application Priority Data

Jan. 30, 2003 (TW) ..... 92201857 U

(51) Int. Cl.[7] ..... A63B 69/36

(52) U.S. Cl. ..... 473/161; 473/153; 473/166; 473/197

(58) Field of Search ..... 473/157–166, 473/170–172, 194–197, 153

(56) References Cited

U.S. PATENT DOCUMENTS 4,215,865 A * 8/1980 Pilati ..... 473/153
4,538,814 A * 9/1985 Cunningham ..... 473/163
4,877,250 A * 10/1989 Centafanti ..... 473/157
5,042,813 A * 8/1991 Huang ..... 473/153
5,123,651 A * 6/1992 Vinciguerra ..... 473/163
5,301,947 A * 4/1994 Kim ..... 473/153
5,409,230 A * 4/1995 Dunaway et al. ..... 473/161
5,857,919 A * 1/1999 Hoyt et al. ..... 473/184
6,050,901 A * 4/2000 Davis ..... 473/160
6,497,625 B2 * 12/2002 Newby ..... 473/163
6,517,444 B1 * 2/2003 Yoon ..... 473/197

* cited by examiner

*Primary Examiner*—Mark S. Graham
(74) *Attorney, Agent, or Firm*—Bacon & Thomas, PLLC

(57) ABSTRACT

A golf training device. The device is used for training a player's approaching skill and putting skill. The device includes a main member, a board, an alley, an assisting board and a cage. The main member has two lateral walls and a back wall and the board. The alley and the assisting board are secured on he base member in sequence and a hole is provided thereon to be the goal. The cage consists of a frame and a net and the frame is mounted on the walls of the base member and the net is secured to the frame. Three elevating assembly are provided between the base member and the board to change slopes of the board. If a ball flies over the base member, the cage will stop it so that the player can practice the approaching skill.

11 Claims, 4 Drawing Sheets

MULTI-FUNCTION GOLF TRAINING DEVICE

BACKGROUND OF THE INVENTION

1. Field of the Invention

The present invention relates to a golf training device, and more particular to a multifunction golf training device for training putting and approaching skill.

2. Description of the Related Art

A conventional golf training device to improve player's putting skill such as an earlier invention of the present inventor mainly consists of a base member on which a movable plate is installed. The movable plate has a hole at a center and a elongated alley extended outwardly. The player puts a ball on the alley adjacent to a distal end thereof and swings a putter to drive the ball to the hole.

Another professional training device for improving player's swinging skill includes a net, similar to a cage for hockey, so that player can stand in front of the net to swing with iron shafts.

SUMMARY OF THE INVENTION

The primary object of the present invention is to provide a golf training device, which can train both of the skills for putting and approaching.

According to the objective of the present invention, a golf training device comprises a base member, a board provided on the base member having a hole for a ball running therein and a cage provided on the base member to stop the ball from flying over the base member.

DETAILED DESCRIPTION OF THE INVENTION

Figure 1:
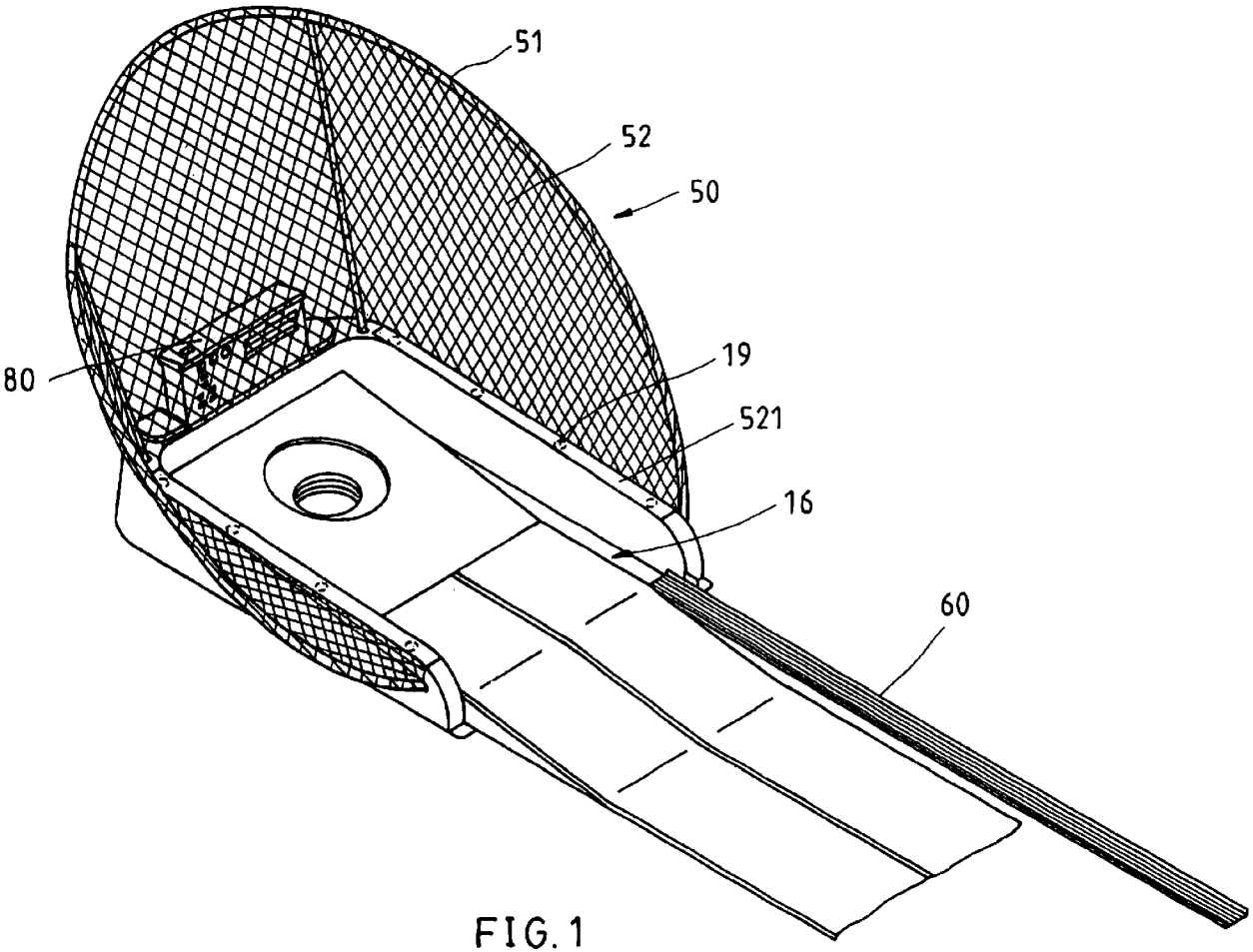
FIG. 1 is a perspective view of a preferred embodiment of the present invention.
Figure 2:
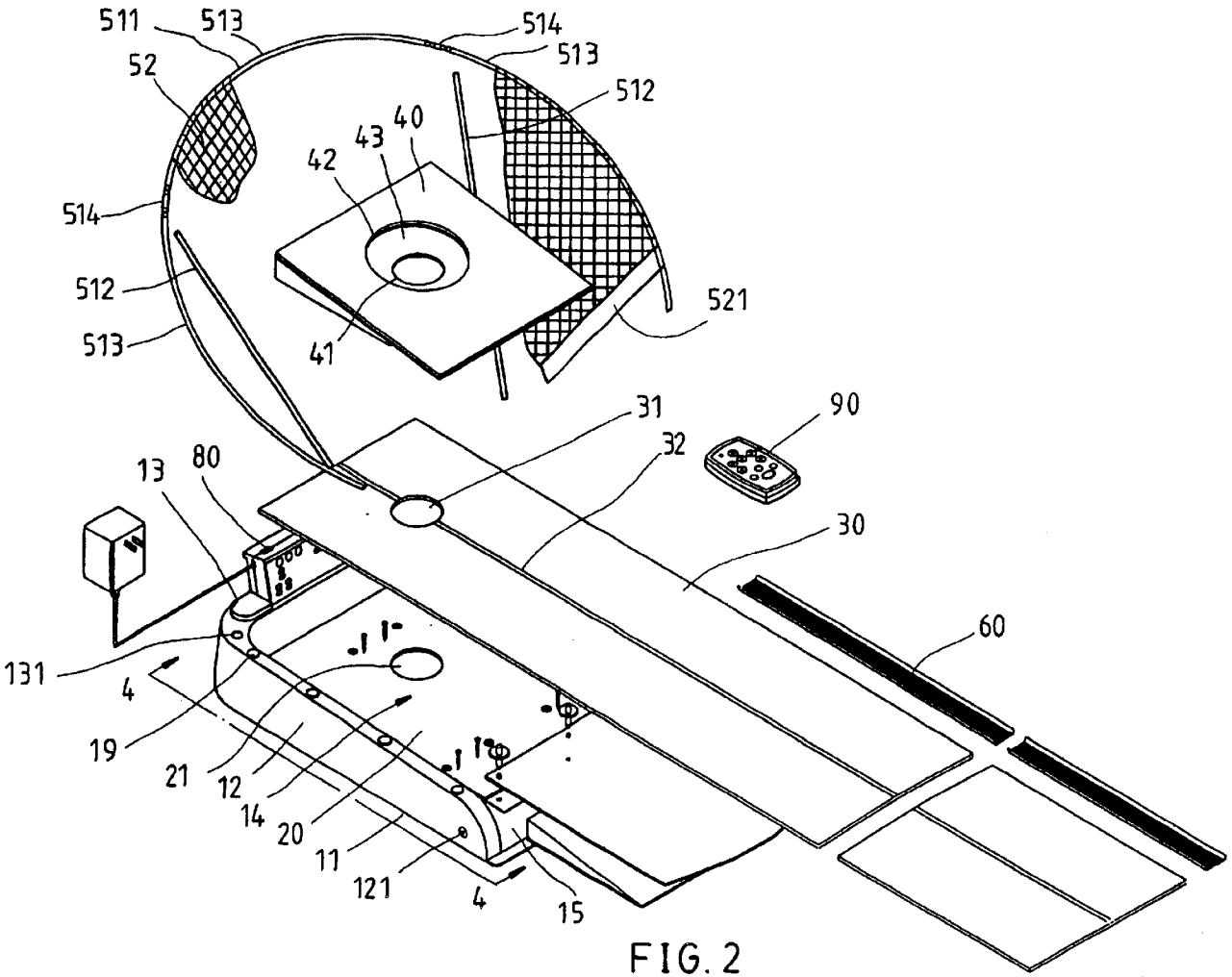
FIG. 2 is an exploded view in part of FIG. 1.
Figure 3:
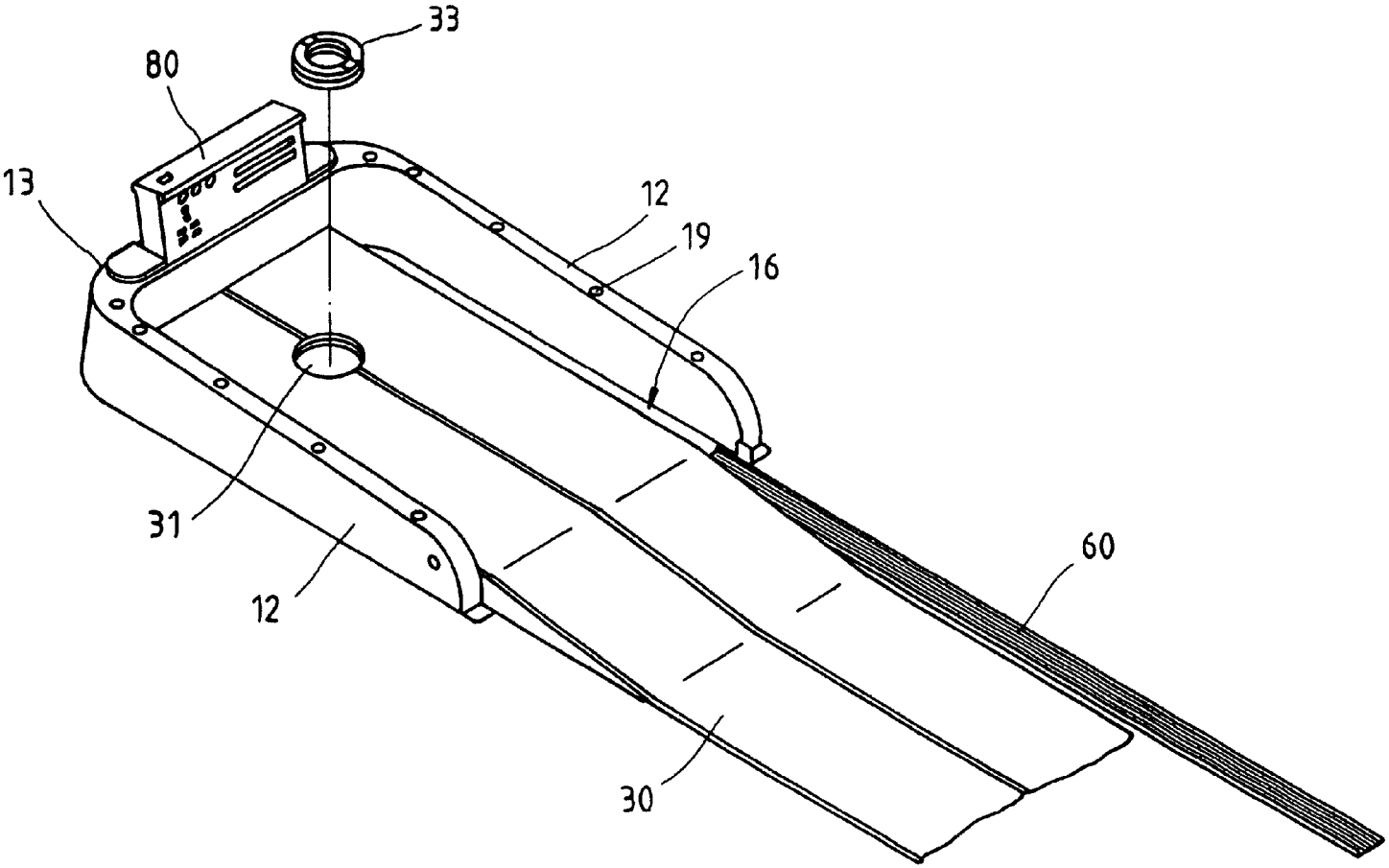
FIG. 3 is a perspective view of the preferred embodiment of the present invention, showing the training device serving as a putting training device.
Figure 4:
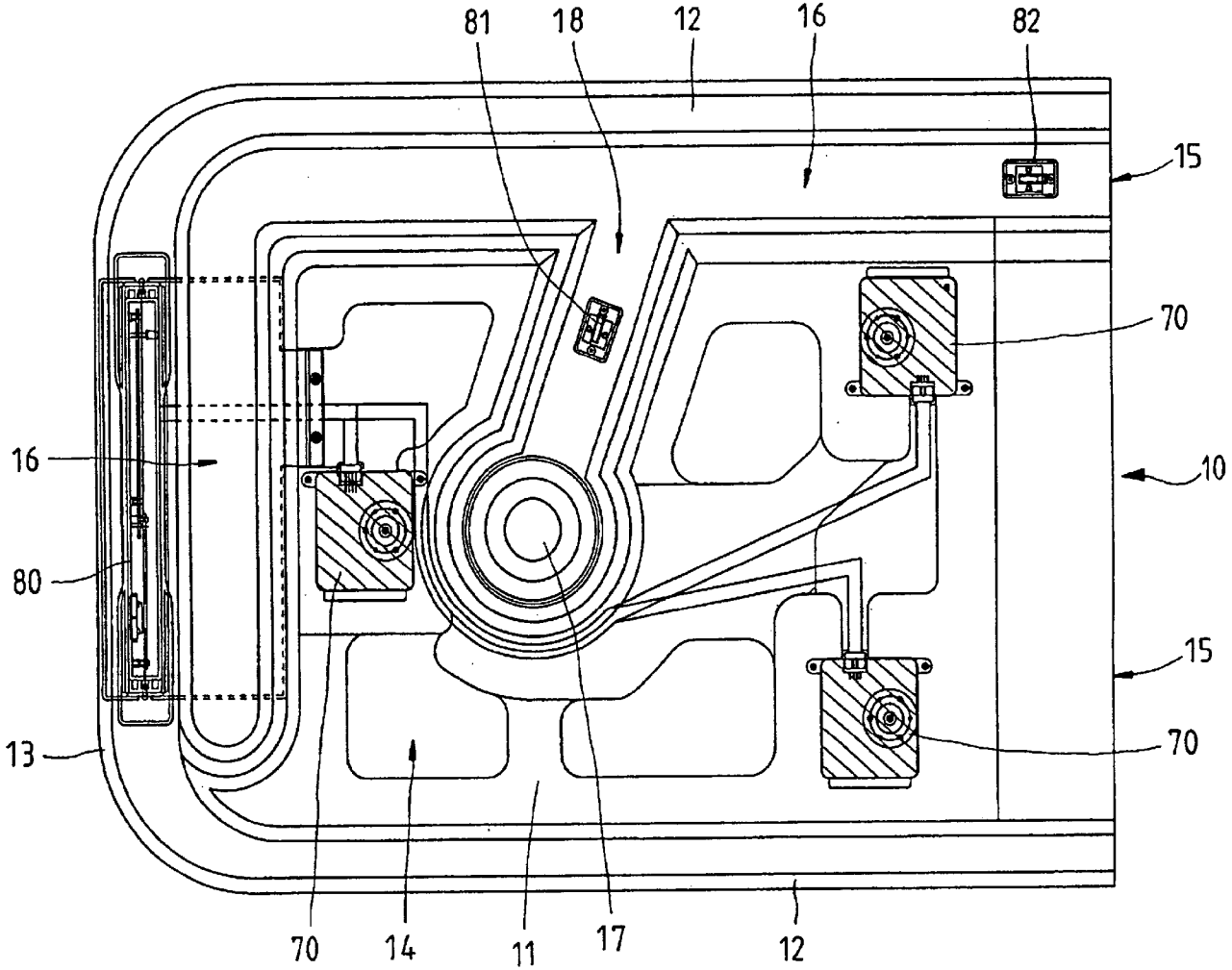
FIG. 4 is a sectional view taken along line 4—4 in FIG. 2.

As shown in the Figures, a golf training device of the preferred embodiment of the present invention includes the following:

A base member 10, as shown in FIG. 4, has a bottom wall 11, two lateral walls 12 projected upwardly from a left and a right end of the bottom wall 11 and a back wall 13 projected upwardly from a rear end of the bottom wall 11. The lateral walls 12 and the back wall 13 surround a center region 14 on the bottom wall 11, at a front end of which has a gap 15 between the lateral walls 12. the bottom wall 11 has an L-shaped return pass 16 on the center region 14 and adjacent to the back wall 13 and the right lateral wall 12 and a round recess 17 at a center of the center region 14. A pass 18 is provided on the bottom wall 11 to communicate the recess 17 with the return pass 16. The return pass 16, the recess 17 and the pass 18 are inclined downwardly from sides adjacent to the back wall 13 to sides adjacent to the gap 15 so that a ball runs to the center region 14 and drops in the recess 17 or the return pass 16 will run back automatically.

A board 20 is provided on the center region 14 of the base member 10 and the board 20 is unsheltered, with the L-shaped return pass 16 allowing balls to run into the return pass 16. The board 20 has a hole 21 thereon relative to the recess 16. The board 20 can be provided on the base member 10 fixedly or movably.

An elongated alley 30 has a part thereof fixed on the board 20 and extends out of the base member 10 via the gap 15 in a predetermined length. The alley 30 has a hole 31 relative to the hole 21 of the board 20 and the recess 17 of the base member 10. The alley 30 is made from a soft plastic to simulate a real alley with grasses. The alley 30 of the present invention further has a red indicating line 32 at a center thereof.

A taped assisting board 40 is installed on the alley 30 within the center region 14 of the base member 10, the taped assisting board 40 having a hole 41 at a bottom thereof relative to the holes 31 and 21 on the alley 30 and the board 20 and the recess 17 of the base member 10. The assisting board 40 further has a larger hole 42 at a top thereof above the hole 41 and a cone sidewall 43 extended from the hole 42 to the hole 41 so that balls can run into the recess 17 easier.

A cage 50 has a frame 51 and a net 52, wherein the frame 51 has an arched main frame 511 respectively inserted into holes 121 on exterior sides of the lateral walls 12 of the base member 10. The holes 121 are located at positions adjacent to the gap 15. The frame 51 further has two posts 512 with ends fixed to the main frame 511 and other ends thereof inserted into holes 131 on a top of the back wall 13 to support the main frame 511 upwardly. The net 52 has an end fixed on the main frame 511 and the other end 521 detachably fixed to the lateral walls 12 and the back wall 13 by hook and loop devices 19 so that the cage 50 is higher at the rear end of the base member 10 and is lower at the front end of the base member 10. In the present preferred embodiment, the main frame 51 consists of three flexible plastic bars 513 in connection with each other. Two T-shaped connectors 514 are provided to connect the bars 513 and the posts 512 respectively. The posts 512 are made from the same material as the bars 513.

In use, a player puts a ball on the alley 30 and swings a pitching wedge or a sand wedge to practice approaching skill. If the ball flies over the base member 10, the cage 50 will stop the ball and drop the ball in the return pass 16 along the extension 60. If the ball runs into the recess 17 via the holes 42, 41, 31 and 21, the ball will run to the pass 18 and enter the return pass 16. In the other words, the ball will return to the player whether the ball is in the recess 17 or misses the recess 17 so that the player can practice continuously.

The assisting board 40 can be removed to reduce the size of the hole on the center region 14, to raise the difficulty level.

The cage 50 can be removed so that the training device of the present invention can serve as a putting training device. In this mode, the player puts a ball on the alley 30 and putts the ball to the recess 17. A ring 33 can be installed in the hole 31 to reduce the size of the hole.

There are three automatically elevating assemblies 70 provided on the bottom wall 11 and a controller 80 at a rear side of the back wall 13 which controls the actions of the elevating assemblies 70 by a program or a remote control 90. The elevating assemblies 70 connect the flexible board 20 so that any movement of each of the elevating assemblies will change the slope of the board 20. The main member 10 has a detecting device 81 in the pass 18 and a detecting device 82 in the return pass 16. The detecting devices 81 and 82 are microswitches which will transmit signals to the controller 80 when the ball runs over them. If the ball runs into the recess 17, the microswitch 81 will be activated when the ball runs through the pass 18 and the controller 81 will receive a signal to confirm that the ball is in the hole, and then the ball will run to the return pass 16 and activate the microswitch 82, and the controller 80 will receive a time signal for putting or approaching. If the ball misses the recess, only the microswitch 82 in the return pass 16 will be activated so that the controller 80 only receives a signal of a time for putting or approaching. The times of ball in hole and the times of putting or approaching are counted and shown on a display (not shown) respectively. The controller 80 can be programmed to automatically activate the elevating assemblies 70 after a predetermined number of times the ball is in the hole, to change the slope of the board 20 so that the player will have different types of challenging greens.

What is claimed is:

1. A golf training device, comprising:

a base member;

a board provided on the base member, the board having a hole for receiving a ball;

a cage provided on the base member to stop the ball flying over the base member, the cage has a frame detachably mounted on the base member and a net with a top thereof secured on the frame and a bottom thereof detachably connected to the base member; and the frame has a substantially arched main frame and two posts, wherein the main frame has opposite ends detachably secured to lateral walls on lateral sides of the base member respectively and adjacent to a front side of the main member and the posts have ends connected to the main frame and other ends connected to a back wall on a rear side of the base member so that the cage is higher at the rear side of the base member and lower at the front side of the base member.

2. The golf training device as defined in claim 1, wherein the base member has a bottom wall, two lateral walls at opposite lateral sides of the bottom wall respectively and a back wall at a rear side of the bottom wall, wherein the lateral walls and the back wall surround a center region on the bottom wall and form a gap at a front side of the bottom wall and the bottom wall has a return pass extended thereon and adjacent to the back wall and one of the lateral walls and a recess at a center thereof and a pass in communication with the recess and the return pass, wherein the return pass, the recess and the pass are extended downwardly from sides adjacent to the back wall to sides adjacent to the gap.

3. The golf training device as defined in claim 2, wherein the board is unsheltered and has a hole in communication with the recess of the bottom wall.

4. The golf training device as defined in claim 1, further comprising an assisting board having a hole relative to the hole of the board and the hole of the assisting board is larger than the hole of the board.

5. The golf training device as defined in claim 4, wherein the assisting board is a taped element which is thicker at an end thereof adjacent to the back wall and is thinner at an end adjacent to the gap.

6. The golf training device as defined in claim 1, wherein the main frame has three flexible bars and two connectors connecting the bars.

7. The golf training device as defined in claim 1, further comprising at least one hook and loop device provided between the net and the base member to detachably secure the net on the base member.

8. The golf training device as defined in claim 2, wherein the board is pivoted on the base member to change slopes of the board.

9. The golf training device as defined in claim 8, further comprising three elevating assemblies provided between the base member and the board to change the slopes of the board.

10. The golf training device as defined in claim 8, further comprising a controller provided on the base member to control the elevating assemblies via one of a program and a remote control.

11. The golf training device as defined in claim 10, further comprising two detaching devices provided in the return pass and the pass respectively to provide signals to the controller when a ball runs over the detecting devices.

* * * * *